US005617587A

United States Patent [19]

Marchbanks

[11] Patent Number: 5,617,587

[45] Date of Patent: Apr. 8, 1997

[54] ATTACHABLE GARMENT POCKET SYSTEM

[76] Inventor: J. Ralph Marchbanks, 6416 Penrose La., Las Vegas, Nev. 89107

[21] Appl. No.: 615,114

[22] Filed: Mar. 14, 1996

[51] Int. Cl.[6] ..... A41D 27/20

[52] U.S. Cl. ..... 2/247

[58] Field of Search ..... 2/247, 248, 249, 2/250, 251, 252, 253, 254

[56] References Cited

U.S. PATENT DOCUMENTS

| | | | |
|---|---|---|---|
| 1,310,125 | 7/1919 | Lundberg et al. | 2/247 |
| 1,583,674 | 5/1926 | Desilets | 2/248 |
| 2,389,697 | 11/1945 | Stoeckert | 2/247 |
| 2,591,059 | 4/1952 | Frohman | 2/247 |
| 3,840,901 | 10/1974 | Eyster | 2/247 |
| 4,266,300 | 5/1981 | Partridge | 2/247 |
| 4,389,801 | 8/1983 | Sharrock et al. | 40/159 |
| 4,651,355 | 3/1987 | White | 2/247 |
| 5,168,580 | 12/1992 | Foo | 2/247 X |

*Primary Examiner*—C. D. Crowder
*Assistant Examiner*—Shirra L. Jenkins
*Attorney, Agent, or Firm*—Joseph N. Breaux

[57] ABSTRACT

An attachable garment pocket system comprising a pocket member, having a plurality of pocket member securing apertures formed therethrough adjacent a portion of the perimeter thereof; an adhesive member having a like plurality of adhesive member securing apertures formed therethrough in alignable registration with the plurality of pocket securing apertures, the adhesive member having first and second opposite sides each having a quantity of a fabric adhering adhesive deposited thereon and first and second peel away covers, respectively, disposed thereover; and a like plurality of identical pairs of permanent pocket securing fasteners having a male portion and a female portion. Each male portion includes an engagement ledge formed at a first end of a central portion thereof and a contoured cap portion formed at a second end of the central portion. Each female portion includes a receiving portion having an engagement cavity formed therein and three ledge retaining flaps extending circumferentially along a sidewall of the receiving portion defining the engagement cavity. The engagement cavity is sized and the retaining flaps are oriented in a manner such that, when the engagement ledge is forced into the engagement cavity past any ledge retaining flap, contact between the engagement ledge and a ledge retaining flap prevents withdrawal of the engagement ledge from the engagement cavity.

9 Claims, 1 Drawing Sheet

ATTACHABLE GARMENT POCKET SYSTEM

TECHNICAL FIELD

The present invention relates to attachable pockets for garments and more particularly to a system for attaching a pocket to a garment that includes two mechanisms for securing the attachable pocket to the garment.

BACKGROUND ART

The pockets of a garment are generally subject to a greater degree of use than most other portions of a garment. Because of this greater use, the pockets typically wear out or are damaged through normal wear and/or misuse. Also, numerous styles of shirts are made without pockets resulting in hundreds of thousands of casual shirt wearers having to place for pencils, notes, cigarettes etc. It would be desirable, therefore, to have an attachable pocket system that allowed a user to attach a new pocket to a garment a replace a damaged pocket without the need for a sewing machine or sewing skills. It would be a further benefit if the attachable pocket system is included more than one mechanism for securing the pocket to a garment in order to insure the pocket remains attached to the garment.

GENERAL SUMMARY DISCUSSION OF INVENTION

It is thus an object of the invention to provide an attachable garment pocket system that allows user to attach a new pocket to the garment without the need for a sewing machine or sewing skills.

It is a further object of the invention to provide an attachable garment pocket system that includes more than one mechanism for securing the pocket to a garment.

It is a still further object of the invention to provide an attachable garment pocket system that accomplishes both of the above objects in combination.

Accordingly, an attachable garment pocket system is provided. The attachable garment pocket system comprises a pocket member having a plurality of pockets member securing apertures formed therethrough adjacent a portion of the perimeter thereof; an adhesive member having a like plurality of adhesive member securing apertures formed therethrough in alignable registration with the plurality of pocket securing apertures, the adhesive member having first and second opposite sides thereof, each first and second side having a quantity of a fabric adhering adhesive deposited thereon and first and second peel away covers, respectively, disposed over one of the quantities of fabric adhering adhesive; and a like plurality of identical pairs of permanent pocket securing fasteners having a male portion and a female portion, each male portion of the plurality of permanent pocket securing fasteners including an engagement ledge formed at a first end of a central portion thereof and a contoured cap portion formed at a second end of the central portion, each female portion of the plurality of permanent pocket securing fasteners including a receiving portion having an engagement cavity formed therein and three ledge retaining flaps extending circumferentially along a sidewall of the receiving portion defining the engagement cavity. The engagement cavity is sized and the retaining flaps are oriented in a manner such that, when the engagement ledge is formed into the engagement cavity past any ledge retaining flap, contact between the engagement ledge and a ledge retaining flap prevents withdrawal of the engagement ledge from the engagement cavity.

In use, the pocket is attached to the garment in the following manner: the peel away covers are peeled away; the first side of the adhesive member is positioned against the pocket member with the plurality of pocket member securing apertures in registration with the like plurality of adhesive member securing apertures; the second side of the adhesive member is then positioned onto the garment in the desired location; a hole is then formed through the garment at the location of each of the plurality of pocket member securing apertures; one of the male portions of one of the like plurality of identical pairs of permanent pocket securing fasteners is then is positioned sequentially through the pocket securing aperture, the adhesive member securing aperture and one of the holes formed through the garment; one of the female portions of the like plurality of identical pairs of permanent pocket securing fasteners is then positioned over the engagement ledge of the male portion and forced into the engagement cavity past at least one of the ledge retaining flaps.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
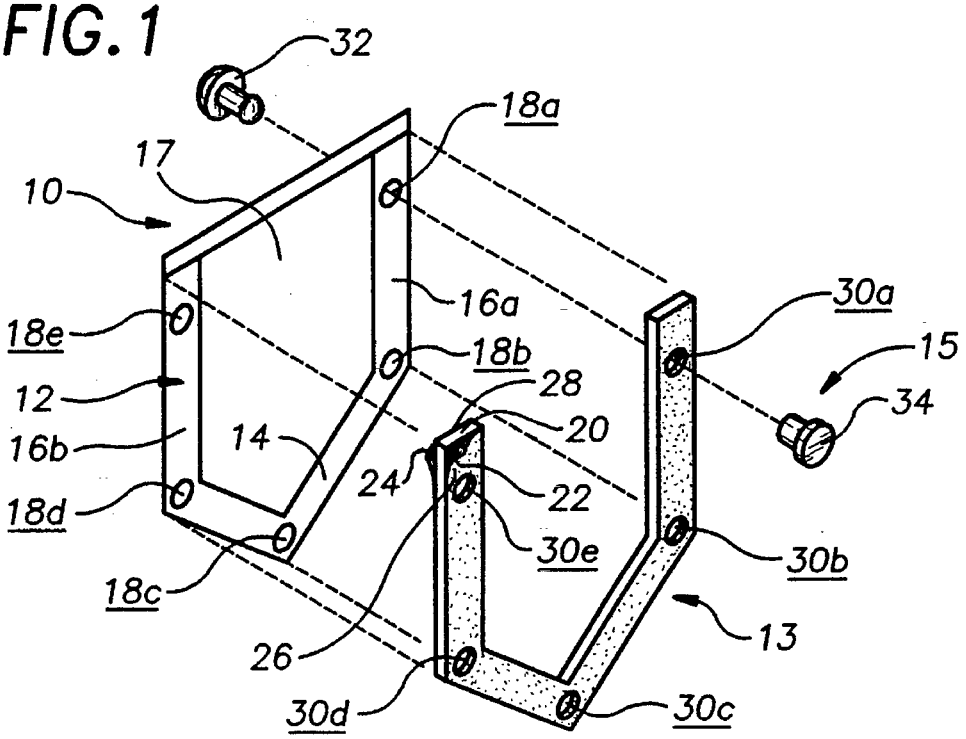
FIG. 1 is an exploded perspective view of an exemplary embodiment of the attachable garment pocket system of the present invention showing a fabric pocket member having five pocket member securing apertures formed therethrough; an adhesive member having five adhesive member securing apertures formed therethrough in alignable registration with the five pocket securing apertures; and one of five identical pairs of permanent pocket securing fasteners.

FIG. 1 shows an exploded view of an exemplary embodiment of the attachable garment pocket system of the present invention, generally designated by the numeral 10. Pocket system 10 includes a fabric pocket member, generally designated by the numeral 12; an adhesive member, generally designated by the numeral 13; and five identical pairs of permanent pocket securing fasteners, generally designated by the numeral 15, (only one pair shown).

Fabric pocket member 12 is constructed from conventional woven textile fabric and formed into a conventional patch type pocket having a central section 17, a V-shaped bottom perimeter portion 14 and two parallel perimeter side portions **16*a*, 16*b*. V-shaped perimeter bottom portion 14 and parallel perimeter side portions 16*a*, 16*b* are formed of double thicknesses of the woven textile fabric that are stitched or adhesively secured together. Five pocket member securing apertures 18***a*, 18*b*, 18*c*, 18*d*, 18*e* are formed through V-shaped perimeter bottom portion 14 and the two parallel perimeter side portions 16*a*, 16*b*. Three of the pocket member securing apertures 18*b*, 18*c*, 18*d* are positioned at corners of pocket member 12. The remaining two pocket member securing apertures 18*a*, 18*e* are positioned, one each, at the top end of each of the parallel side portions 16*a*, 16*b* respectively.

Adhesive member 13 including a central fabric core section 20 that is shaped to register with V-shaped perimeter bottom portion 14 and the two parallel perimeter side portions 16*a*, 16*b*. Core section 20 has first and second opposed sides coated with quantities of fabric adhering adhesive 22, 24. Each quantity of fabric adhering adhesive 22, 24 is covered with a coated paper, peel away cover 26, 28, respectively. Five adhesive member securing apertures 30*a*, 30*b*, 30*c*, 30*d*, 30*e* are formed through core section 20 coated paper, peel away covers 26, 28, in alignable registration with the five pocket securing apertures 18*a*, 18*b*, 18*c*, 18*d*, 18*e*, respectively.

Figure 2:
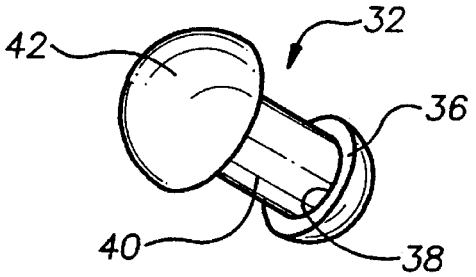
FIG. 2 is a perspective view of one of the male portions of the five permanent pocket securing fasteners showing the engagement ledge formed at a first end of a central portion thereof and a contoured cap portion formed at a second end of the central portion.

Each of the five identical hairs of permanent pocket securing fasteners 15 includes a male portion 32 and a female portion 34. With reference to FIG. 2, each male portion 32 includes an engagement ledge 36 formed at a first end 38 of a central portion 40 thereof and a hemispherical cap portion 42 formed at a second end of central portion 40. Male portion 32 is constructed from injection molded nylon. A delerin plastic is also suitable for constructing male portion 32 and female portion 34.

Figure 3:
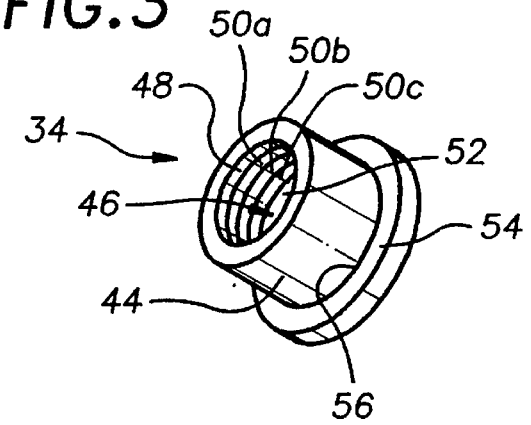
FIG. 3 is a perspective view of one of the female portions of the five permanent pocket securing fasteners showing the engagement cavity including three circumferential ledge retaining flaps along the sidewalls of the engagement cavity.
Figure 4:
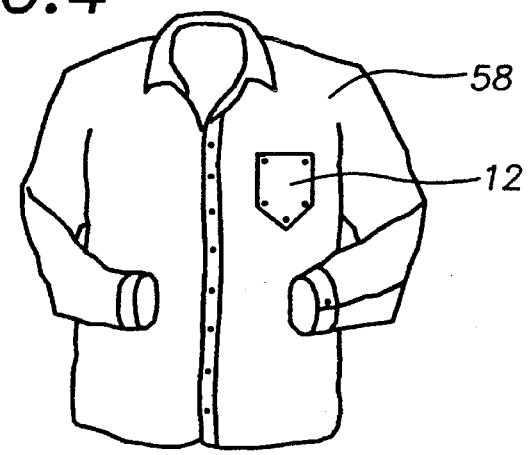
FIG. 4 is a plan view of the exemplary pocket attachment system in use with a representative garment.

With reference to FIG. 3, each female portion 34 is constructed from injection molded nylon and includes a receiving portion 44 having a cylindrically shaped engagement cavity 46 formed therein and defined by an internal sidewall 48. Three ledge retaining flaps 50*a*, 50*b*, 50*c* extend circumferentially around sidewall 48 and protrude away from and toward a bottom surface 52 of engagement cavity 48. A cylindrical cap plate 54 extends outwardly from a cap end 56. The diameters of cylindrical cap plate 54 and hemispherical cap portion 42 are greater than the diameters of pocket member securing apertures 18*a*, 18*b*, 18*c*, 18*d*, 18*e* and adhesive member securing apertures 30*a*, 30*b*, 30*c*, 30*d*, 30*e*.

The internal diameter of engagement cavity 46 is sized and retaining flaps 50*a*, 50*b*, 50*c* are oriented in a manner such that, engagement ledge 36 can be forced into the engagement cavity past any ledge retaining flap 50*a*, 50*b*, 50*c*. However, once forced past a ledge retaining flap 50*a*, 50*b*, 50*c*, contact between engagement ledge 36 and one of the ledge retaining flaps 50*a*, 50*b*, 50*c* prevents withdrawal of engagement ledge 36 from engagement cavity 46.

An exemplary method of using the exemplary attachable pocket system 10 is now described with general reference to FIGS. 1–4. With specific reference to FIG. 4, pocket member 12 is attached to a representative garment 58 according to the following method to form a pocket on representative garment 58. Peel away covers 26, 28 are first peeled away from adhesive 22, 24. First side of adhesive member 13 is then positioned against pocket member 12 with the plurality of pocket member securing apertures 18*a*–18*e* in registration with the like plurality of adhesive member securing apertures 30*a*–30*e*. The second side of adhesive member 13 is then positioned onto representative garment 58 in the desired location. Five holes are then formed through representative garment 58, one each at the location of each of the plurality of pocket member securing apertures 18*a*–18*e*. Each of the male portions 32 of one of the like plurality of identical pairs or, permanent pocket securing fasteners 15 is then is positioned sequentially through a pocket securing aperture 18*a*–18*e*, an adhesive member securing aperture 30*a*–30*e*, and one of the holes formed through representative garment 58. Each of the female portions 34 of the like plurality of identical pairs of permanent pocket securing fasteners 15 is then positioned over one of the engagement ledges 36 of each male portion 32 and forced into the engagement cavity 46 past at least one of the ledge retaining flaps 50*a*, 50*b*, 50*c*. Three ledge retaining flaps are provided to allow attachable pocket system 10 to be utilized with a variety of different weights and thicknesses of fabric.

It can be seen from the preceding description that an attachable garment pocket system has been provided that allows a user to attach a new pocket to the garment without the need for a sewing machine or sewing skills; and that includes more than one mechanism for securing the pocket to a garment.

It is noted that the embodiment of the attachable garment pocket system described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. An attachable garment pocket system comprising:

a pocket member having a plurality of pocket member securing apertures formed therethrough adjacent a portion of said perimeter thereof;

an adhesive member having a like plurality of adhesive member securing apertures formed therethrough in alignable registration with said plurality of pocket securing apertures, said adhesive member having first and second opposite sides thereof, each first and second side having a quantity of a fabric adhering adhesive deposited thereon and first and second peel away covers, respectively, disposed over one of said quantities of fabric adhering adhesive; and a like plurality of identical pairs of permanent pocket securing fasteners having a male portion and a female portion, each male portion of said plurality of permanent pocket securing fasteners including an engagement ledge formed at a first end of a central portion thereof and a contoured cap portion formed at a second end of said central portion, each female portion of said plurality of permanent pocket securing fasteners including a receiving portion having an engagement cavity formed therein and three ledge retaining flaps extending circumferentially along a sidewall of said receiving portion defining said engagement cavity, said engagement cavity being sized and said retaining flaps being oriented in a manner such that when said engagement ledge is forced into said engagement cavity past any ledge retaining flap, contact between said engagement ledge and a ledge retaining flap prevents withdrawal of said engagement ledge from said engagement cavity.

2. The attachable garment pocket system of claim 1, wherein:

each said cap portion is hemispherically shaped.

3. The attachable garment pocket system of claim 2, wherein:

said male portion is constructed from nylon.

4. The attachable garment pocket system of claim 3 wherein:

each said female portion is constructed from nylon.

5. The attachable garment pocket system of claim 1 wherein:

each said engagement cavity is cylindrically shaped and defined by an internal sidewall.

6. The attachable garment pocket system of claim 5, wherein:

each said cap portion is hemispherically shaped.

7. The attachable garment pocket system of claim 6, wherein:

said male portion is constructed from nylon.

8. The attachable garment pocket system of claim 7 wherein:

each said female portion is constructed from nylon.

9. A method of securing a pocket to a garment comprising the steps of:

a) providing a pocket member having a plurality of pocket member securing apertures formed therethrough adjacent a portion of said perimeter thereof;

b) providing an adhesive member having a like plurality of adhesive member securing apertures formed therethrough in alignable registration with said plurality of pocket securing apertures, said adhesive member having first and second opposite sides thereof, each first and second side having a quantity of a fabric adhering adhesive deposited thereon and first and second peel away covers, respectively, disposed over one of said quantities of fabric adhering adhesive;

c) providing a like plurality of identical pairs of permanent pocket securing fasteners having a male portion and a female portion, each male portion of said plurality of permanent pocket securing fasteners including an engagement ledge formed at a first end of a central portion thereof and a contoured cap portion formed at a second end of said central portion, each female portion of said plurality of permanent pocket securing fasteners including a receiving portion having an engagement cavity formed therein and three ledge retaining flaps extending circumferentially along a sidewall of said receiving portion defining said engagement cavity, said engagement cavity being sized and said retaining flaps being oriented in a manner such that, when said engagement ledge is forced into said engagement cavity past any ledge retaining flap, contact between said engagement ledge and a ledge retaining flap prevents withdrawal of said engagement ledge from said engagement cavity;

d) peeling said first and second peel away covers away from said quantity of fabric adhering adhesive;

e) positioning said first side of said adhesive member against said pocket member with said plurality of pocket member securing apertures in registration with said like plurality of adhesive member securing apertures;

f) positioning said second side of said adhesive member onto said garment in a desired location;

g) forming a hole through said garment at a location of each of said plurality of pocket member securing apertures;

h) positioning one of said male portions of one of said like plurality of identical pairs of permanent pocket securing fasteners sequentially through said pocket securing aperture, said adhesive member securing aperture and one of said holes formed through said garment;

I) positioning one of said female portions of said like plurality of identical pairs of permanent pocket securing fasteners over said engagement ledge of each said one of said male portions;

j) forcing said engagement ledge of each said one of said male portions into said engagement cavity past at least one of said ledge retaining flaps.

* * * * *